United States Patent [19]

Sugai et al.

[11] Patent Number: 4,864,188

[45] Date of Patent: Sep. 5, 1989

[54] NI-FE BASE ALLOY SHEET FOR USE AS A SHADOW MASK AND A SHADOW MASK EMPLOYING THE SAME

[75] Inventors: Shinzo Sugai; Fumio Mori, both of Yokohama, Japan

[73] Assignee: Kabushiki Kaisha Toshiba, Kawasaki, Japan

[21] Appl. No.: 126,893

[22] Filed: Nov. 30, 1987

[51] Int. Cl.[4] ..... H01J 29/07

[52] U.S. Cl. ..... 313/402

[58] Field of Search ..... 148/320, 325, 327; 420/27, 43, 94–98, 112, 584–585; 313/402

[56] References Cited

U.S. PATENT DOCUMENTS 4,724,012 2/1988 Inaba et al. ..... 420/43 X

FOREIGN PATENT DOCUMENTS 50-58977 5/1975 Japan .

*Primary Examiner*—Kenneth Wieder

*Attorney, Agent, or Firm*—Foley & Lardner, Schwartz, Jeffery, Schwaab, Mack, Blumenthal & Evans

[57] ABSTRACT

Disclosed is an Invar alloy original sheet for use in the production of a shadow mask, wherein the Invar alloy original sheet has the cleanliness measured by the method regulated in JIS G 0555, of 0.07% or less.

Disclosed is also a shadow mask comprising an Invar alloy original sheet having the cleanliness mentioned above.

By use of the Invar alloy original sheet of this invention, the problem of non-uniformity and irregurarity of inner wall surface of perforations formed on the original sheet for shadow mask is decreased to a great extent.

6 Claims, 1 Drawing Sheet

NI-FE BASE ALLOY SHEET FOR USE AS A SHADOW MASK AND A SHADOW MASK EMPLOYING THE SAME

BACKGROUND OF THE INVENTION

This invention relates to an Invar alloy for use in a shadow mask and a shadow mask employing the same, and, more particularly, to an Invar alloy for use in a shadow mask and of the composition suited for forming a perforated matrix by etching.

The shadow mask that has a great number of perforations made in the form of a matrix on the basis of a given design standard is provided right in front of the fluorescent face of a color picture tube. Electron beams shot from electron guns positioned rearward pass through these perforations and are irradiated on fluorescent dots at given position on the fluorescent face to reproduce a color image thereon. At this time, however, it does not follow that all of the shot electron beams pass through the perforations, and a part of them directly bombards with the shadow mask to heat the shadow mask. As a result, the shadow mask may expand, so that the position of the perforations may get out of the designed standard position and be displaced to cause sometimes the phenomenon of color deviation.

For this reason, it has been conventionally practiced that the shadow mask is supported with a bimetal so that the whole of the shadow mask may be brought close to the fluorescent face with utilization of the bending of the bimetal when heated.

Recent years, it is also attempted to constitute the shadow mask itself with use of an Invar alloy which is a Ni-Fe base alloy typified by a 36% Ni-Fe alloy and endowed with a low thermal expansion characteristic, to prevent the phenomenon of color deviation.

In producing the shadow mask from this Invar alloy, a lump of Invar alloy of given composition is casted, for example, in a cast iron mold, and then forged and rolled to an original sheet having a given thickness. The thickness usually ranges from 0.1 to 0.3 mm. Subsequently, this original sheet is etched with use of, for example, a ferric chloride solution on the position to be perforated, to make perforations of given shape in the form of dots or a reed screen, followed by pressing to set its whole shape, and thereafter the whole thereof is oxidized, for example, with steam to blacken its surface for the purposes of improving heat radiation ability and preventing irregular reflection.

On the other hand, the Invar alloy used as material for the original sheet include various types conventionally known, but, in general, include those in which non-metallic inclusions typified by oxides, carbides and sulfides such as MnO, $SiO_2$, MgO, $Al_2O_3$, MnS and TiC, which may give influence to etching, are uniformly dispersed in alloy matrices such as Ni and Fe in the form of particles.

When the etching is effected on the original sheet of the Invar alloy having the alloy composition mentioned above, microscopic observation of the perforations thus bored can reveal a state such that the shape of the perforations is not in conformity with the shape pursuant to the design standard and thus the perforations are irregularly deformed or irregularities appear on inner wall faces of the perforations.

If the perforations are formed in such a state, it may follow that the electron beams shot from electron guns are not irradiated on the fluorescent face in an appropriate state because the course of irradiation is hindered by the irregularity of the shape of perforations and the state of the inner walls, causing the phenomenon of color deviation in short.

In addition to the problem of the non-uniformity of the inner walls of the perforations, the perforations formed by etching may have a problem that, as shown in FIG. 1, they have a large inner diameter at the surface part of the original sheet and on the other hand have a small inner diameter at the thicknesswise central part of the original sheet, and thus it is required to make the inner diameter as uniform as possible in the range of from the surface part to thicknesswise central part of the original sheet, preferably to make the inner diameter (R) at the surface part within 4-fold of the inner diameter (r) at the thicknesswise central part. In FIG. 1, 1 is an original sheet and 2 is a perforation

SUMMARY OF THE INVENTION

An object of this invention is to provide an Invar alloy for a shadow mask that can eliminate the above problems and can be effective for forming a desirable perforated matrix in the etching process, and also provide a shadow mask employing the same.

To achieve the above object, the present inventors have made detailed studies on the composition and structure of the starting Invar alloys, and reached a finding as follows:

That is, it is a finding that the Invar alloy, which is an alloy chiefly composed of Ni and Fe and in which, in general, non-metallic inclusions such as oxides, carbides and sulfides, e.g. MnO, $SiO_2$, MgO, $Al_2O_3$, Mns and TiC and are uniformly dispersed in alloy matrices such as Ni and Fe in the state of particles, shows a difference in the etching speed when the matrices and the non-metallic inclusions are etched by an etchant (in general, the etching speed is very high at the surrounding part of non-metallic inclusions), so that the etching may proceed only at the surrounding part of non-metallic inclusions to make holes at that part, resulting in the occurrence of irregular holes, or causing irregular protuberances to appear because of the non-metallic inclusions that may remain on the inner walls of perforations.

Accordingly, the present inventors had an idea that the above problems that may arise in the etching process can be solved if these non-metallic inclusions are made present in a minimal amount, and, as a result of intensive studies made for such an Invar alloy, they finally developed the alloy of this invention as a desirable one.

Namely, the Invar alloy for a shadow mask of this invention is characterized by having the cleanliness measured by the method regulated in JIS G 0555, of 0.07% or less.

Classification of Inclusions

Inclusions are classified into following 3 types:

(1) A type Inclusion: Inclusions formed by viscous deformation during working (sulphides, silicates, etc.). If necessary, they are classified further into sulphides and silicate, and the former shall be called A, type inclusion nd the latter A, type inclusion.

(2) B type inclusion: Inclusions formed by granular inclusions discontinuously and collectively disposed in the working direction (alumina, etc.).

As for the steel containing Nb, Ti and Zr, (only one, or more than two thereof), if necessary, inclusions are further classified into oxide such as alumina and carbonitride of Nb, Ti, and Zr, and the former shell be called $B_1$ type inclusion and the latter $B_2$ type inclusion.

(3) C type Inclusion: Inclusions formed by irregular dispersion without viscous deformation (granular oxide, etc.).

As for the steel containing Nb, Ti, and Zr, (only one, or more than two thereof), if necessary, inclusions are further classified into oxide and carbo-nitride of Nb, Ti, and Zr, and the former shall be called $C_2$ type inclusion and the latter $C_2$ type inclusion.

Testing Method

The glass plate having each 20 grating lines, longitudinal and lateral, shall be inserted in the eyepiece of the microscope, and the test plane shall be observed repeatedly at random. The number of grating points occupied by the inclusions shall be counted.

In this case, the number of visual fields shall, as a rule, be 60 and shall be at least 30 and over.

The magnification of microscope shall, as a rule, be 400.

Method of Determination

By the total number of grating points found on the glass plate within the visual field, the number of visual field, and the number of grating points occupied by inclusions, the percentage of area occupied by the inclusions shall be calculated from the following formula and the index of cleanliness of the steel (d%) shall be determined.

$$d = \frac{n}{pxf} \times 100$$

where p: total number of grating points on the glass plate in the visual field f: number of visual fields n: number of grating points occupied by the inclusions through the visual fields numbering f

Indication

The results of determination shall be indicated as given below:

| | |
|---|---|
| Examples 1. d 60 × 400 = 0.34% . . . | (Expressing number of the observed visual fields is 60, the magnification of microscope is 400, and the index of cleanliness is 0.34%.) |
| 2. d A 60 × 400 = 0.15%<br>d B 60 × 400 = 0.02% . . .<br>d C 60 × 400 = 0.09% | (Expressing number of the observed visual fields is 60, the magnification of microscope is 400, and the index of cleanliness of A, B, and C type inclusions are 0.15%, 0.02%, and 0.00%, respectively.) |

The present inventors have also made intensive studies to solve the aforesaid problems that the original sheet tends to have a smaller inner diameter at its thicknesswise central part than the inner diameter at its surface part, they had a finding that this surface defect is caused by non-metallic inclusions that are uniformly dispersed in both the in-plane direction and thickness direction of the original sheet. In other words, this is because, since the etching is effected from the surface part, the perforation may proceed in a greater extent in the longitudinal direction at the surface part which is subjected to etching for a longer time.

Based on this finding, the present inventors repeated various experiments to examine the relationship between the manner in which the non-metallic inclusions are dispersed in the original sheet and the surface defect which may occur after etching. As a result, they have found a fact that, if the amount of the non-metallic inclusions present at the surface of the original sheet is made smaller than the amount thereof at its thicknesswise central part, there can be eliminated the above problems that the etching speed at the surrounding part of the non-metallic inclusions is so high that the etching speed at the thicknesswise central part containing a larger amount of the non-metallic inclusions may increase and the inner diameter at the thicknesswise central part of the original sheet may decrease because of the above-mentioned difference in the amount of time for etching, whereby the occurrence of the perforation shape and irregularities in perforation diameter can be suppressed.

Namely, in a preferred embodiment, the Invar alloy original sheet for a shadow mask according to this invention is characterized by having a smaller amount of non-metallic inclusions present at the surface part of the original sheet than the amount of those present at the thicknesswise central part of the original sheet.

DESCRIPTION OF THE PREFERRED EMBODIMENTS

Figure 1:
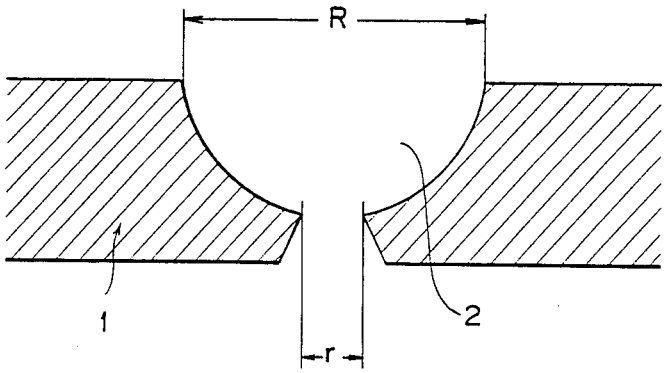
FIG. 1 is a sectional view of a perforation.

There is no particular limitation in the composition of the Invar alloy of this invention, and it may be embraced in the scope of the conventionally known composition. More specifically, the Invar alloy contains 30 to 50% by weight, preferably 35 to 40% by weight of nickel as a main component, and the balance comprising iron and impurities which are unavoidably contained. Impurities may include Si, Mn, Mg, etc. and these may preferably be contained in an amount of 1% by weight, respectively. Further, various elements may be incorporated in such amount that the thermal expansion coefficient of the Invar alloy is not so much increased. Such elements may include chromium, titanium, cobalt aluminum, niobium, zirconium, etc. If these are contained, it is preferable to contain cobalt in an amount of 10% by weight or less, chromium 5% by weight or less, and aluminum, niobium and zirconium 2% by weight or less, respectively. What is most characteristic is that the cleanliness of the Invar alloy has been specified.

An Invar alloy having a cleanliness of more than 0.07% when measured by the method regulated in JIS G 0555 (Microscopic Testing Method for the Non-Metallic Inclusions in Steel) contains the non-metallic inclusions distributed in a large number in its structure, and therefore it frequently occurs that they are exposed at the perforations at the time of etching, disadvantageously resulting in the frequent occurrence of irregular holes having irregularities at the wall face of the perforations, or irregularity in the shape of the perforations. Particularly preferred is an Invar alloy having a cleanliness of 0.03% or less.

The Invar alloy of this invention can be produced in the following manner.

First, a given amount of the respective components for an Invar alloy of desired composition, or a lump of such Invar alloy itself, is melted in a plasma vacuum induction furnace, and the resulting melt is casted in a mold by bottom pouring to form it into an ingot. Use of the plasma vacuum induction furnace in the melting makes it possible to remove in good efficiency the impurity elements constituting the non-metallic inclusions. Also, employment of the bottom pouring makes it possible to prevent the melt from being splashed at the time of pouring and to cause the non-metallic inclusions to float to be separated and removed. Thus, there can be obtained an ingot of an Invar alloy having a high cleanliness.

The cleanliness may vary depending on the kind of deoxidizers (or deoxidizing elements), the manner of the introduction thereof, the melting atmosphere, the refining process, the casting process and the like used in the above method, but, in order for the cleanliness to be controlled to, for example, 0.07% or less, it is preferable to decrease the deoxidizers that tend to leave oxides of Al, Ti, Mg, etc., to carry out the melting in a high vacuum atmosphere (preferably $10^{-2}$ Torr or less), to employ plasma refining, and to employ the bottom pouring system.

The resulting ingot may be forged and rolled according to a conventional method to produce an original sheet for use in the shadow mask.

In instances in which the non-metallic inclusions are made present in a larger amount at the thicknesswise central part than at the surface part according to the preferred embodiment of this invention, the non-metallic inclusions present at the surface part of the original sheet may preferably be in an amount such that the value of the cleanliness measured by the method regulated in JIS G 0555 is 0.01% or less, and the cleanliness at the thicknesswise central part may preferably be of 0.03% or less.

If the cleanliness is more than 0.01% at the surface part of the original sheet the surface defects and the badness in the shape of perforations at the time of etching may be readily caused because of the large amount of the non-metallic inclusions dispersed there. Also, if the cleanliness is more than 0.03% at the thicknesswise central part, the amount of the non-metallic inclusions exposed at the inner walls of the perforations formed becomes so large that it may frequently occur that the electron beams passing here are hindered from passing on their appropriate courses, disadvantageously.

The shadow mask original sheet according to the preferred embodiment of this invention can be produced, for example, in the following manner.

First, respective components are mixed in given amounts to give an Invar alloy of desired composition and the resulting mixture is melted, or an Invar alloy itself of desired composition is melted. The melt thus obtained is continuously casted to make an ingot.

By this continuous casting, the alloy melt can be cooled from its surface part at a greater cooling rate as compared with the casting according to a conventional batch system. As a result, it follows that the non-metallic inclusions in the matrix gather toward its thicknesswise central part. In other words, there is formed a density gradient of the non-metallic inclusions from the surface part toward thicknesswise central part of the ingot.

The cleanliness for the non-metallic inclusions in the original sheet finally obtained can be controlled by selecting the conditions such as the size of the mold, the amount of cooling water and the ingot pulling-down rate in a suitable combination.

To attain the above-mentioned preferred cleanliness distribution in the original sheet of this invention, it is preferable to control the sectional size of the mold to 100 to 200 mm thick and 500 to 1,300 mm wide, the amount of cooling water to 200 to 500 lit/min, and the ingot pulling-down rate to 400 to 2,500 mm/min.

The ingot obtained by such process has a distribution of non-metallic inclusions that the concentration of the non-metallic inclusions is small at the surface part thereof and becomes larger as near to the thicknesswise central part as the point to be measured is, because of rapid cooling.

The ingot obtained by the continuous casting may be forged and rolled according to a conventional method, and worked to a sheet material having a given thickness, thus obtaining the original sheet for the shadow mask according to the preferred embodiment of this invention.

The surface part and thicknesswise central part mentioned in this invention is meant that the part is called the surface part if the ratio of the distance from the surface to a certain position to the distance from the surface to the thicknesswise central part of the original sheet is less than 0.50, and it is called the thicknesswise central part if the same is 0.50 or more.

In the preferred embodiment of this invention, there also can be seen the effect that the strength of the shadow mask itself can be increased if the inner diameter of the perforations is made substantially uniform.

EXAMPLE 1

An Invar alloy of the composition comprising 36% of Ni, 0.3% of Mn, 0.1% of Si, 0.02% of Ti and the balance of Fe was melted in a plasma induction heating furnace. This was carried out under the conditions of a vacuum degree of $4\times10^{-3}$ Torr and a temperature of 1,580° C.

The resulting melt was injected into a mold by bottom pouring, followed by cooling to make an ingot. This ingot was forged according to a conventional method, and further subjected several times to hot rolling and cold rolling to finally making an Invar alloy sheet of 0.2 mm thick.

On this alloy sheet, the cleanliness was measured according to the method following JIS G 0555. Here, the microscope was of 400 magnifications and had a visual field number of 60. As a result, the cleanliness was found to be 0.02%.

This alloy sheet was etched according to a conventional method with use of a ferric chloride solution to form a perforated matrix having a perforation of 0.2 mm $\phi$ in the design standard value to produce a shadow mask.

Microscopic observation under 100 magnifications on 40 perforations selected at random in the matrix revealed that the number of protuberances and cavities comprising non-metallic inclusions and exposed at inner walls of the perforations were found to be 4.5 as an average value.

This shadow mask was supported horizontally with two pieces of bearers and a mirror was obliquely disposed at an upper position thereof. Under such a state, light was irradiated form a lower position of the shadow mask to visually observe images reflected on the mirror, to find that the images had no distribution for light part or dark part and were very homogeneous. In other words, the perforated matrix was formed in a homogeneous state.

EXAMPLE 2

An Invar alloy of the composition comprising 36% of Ni, 0.25% of Mn, 0.12% of Si, 0.03% of Ti and the balance of Fe was melted in a plasma induction heating furnace. This was carried out under the conditions of a vacuum degree of $7\times10^{-3}$ Torr and a temperature of 1,550° C.

The resulting melt was injected into a mold by bottom pouring, followed by cooling to make an ingot. This ingot was forged according to a conventional method, and further subjected several times to hot rolling and cold rolling to finally making an ,Invar alloy sheet of 0.2 mm thick.

On this alloy sheet, the cleanliness was measured according to the method following JIS G 0555. Here, the microscope was of 400 magnifications and had a visual field number of 60. As a result, the cleanliness was found to be 0.06%.

This alloy sheet was etched according to a conventional method with use of a ferric chloride solution to form a perforated matrix having a perforation of 0.2 mm $\phi$ in the design standard value to produce a shadow mask.

Microscopic observation under 100 magnifications on 40 perforations selected at random in the matrix revealed that the number of protuberances comprising non-metallic inclusions and exposed at inner walls of the perforations were found to be 8.5 as an average value.

This shadow mask was supported horizontally with two pieces of bearers and a mirror was obliquely disposed at an upper position thereof. Under such a state, light was irradiated form a lower position of the shadow mask to visually observe images reflected on the mirror, to find that the images had no distribution for light part or dark part and were very homogeneous. In other words, the perforated matrix was formed in a homogeneous state.

EXAMPLE 3

An Invar alloy of the composition comprising 36% of Ni, 0.35% of Mn, 0.15% of Si, 0.02% of Ti and the balance of Fe was melted in a plasma induction heating furnace. This was carried out under the conditions of a vacuum degree of $9\times10^{-3}$ Torr and a temperature of 1,530° C.

The resulting melt was injected into a mold by bottom pouring, followed by cooling to make an ingot. This ingot was forged according to a conventional method, and further subjected several times to hot rolling and cold rolling to finally making an Invar alloy sheet of 0.2 mm thick.

On this alloy sheet, the cleanliness was measured according to the method following JIS G 0555. Here, the microscope was of 400 magnifications and had a visual field number of 60. As a result, the cleanliness was found to be 0.09%.

This alloy sheet was etched according to a conventional method with use of a ferric chloride solution to form a perforated matrix having a perforation of 0.2 mm $\phi$ in the design standard value to produce a shadow mask.

Microscopic observation under 100 magnifications on 40 perforations selected at random in the matrix revealed that the number of protuberances comprising non-metallic inclusions and exposed at inner walls of the perforations were found to be 14.4 as an average value.

This shadow mask was supported horizontally with two pieces of bearers and a mirror was obliquely disposed at an upper position thereof. Under such a state, light was irradiated form a lower position of the shadow mask to visually observe images reflected on the mirror, to find that the images had irregular distribution for light part or dark part and were unhomogeneous. In other words, the perforated matrix was formed in an unhomogeneous state.

EXAMPLE 4

(1) Production of an original sheet:

An Invar alloy of the composition comprising 36% of Ni, 0.3% of Mn, 0.1% of Si, 0.02% of Ti and the balance of Fe was put in a crucible and melted at 1,580° C. The resulting melt was flowed out from a tundish at a flow-out rate of 600 kg/min to carry out continuous casting. Here, the melt was cooled to 850° C. while it runned a distance of 6 m from the tundish to pinch rolls. The cooling rate was 140° C./min.

The resulting ingot was subjected to blooming, and further to hot rolling and cold rolling to finally make an Invar alloy sheet of 0.2 mm thick.

(2) Measurement of cleanliness:

A sample available after the blooming was cut in the thickness direction, and the cut face was polished. This cut face was measured to find its cleanliness from the surface part down to the thicknesswise central part according to the method following JIS G 0555. The microscope was of 400 magnifications and had a visual field number of 60.

Assuming as x the ratio of the distance from the surface to a certain position to the distance from the surface to the thicknesswise central part of the original sheet, the relationship between this x and the cleanliness is shown in the table following. In this invention, the thicknesswise central part refers to an inner part at which the ratio x is 0.5 or more.

TABLE

| Ratio (x) of the distance from the surface to the central part | 1 (Central) | 0.75 | 0.5 | 0.25 | 0 (Surface) |
|---|---|---|---|---|---|
| Cleanliness (%) | 0.015 | 0.013 | 0.011 | 0.007 | 0.007 |

The original sheet obtained in the above (1) was etched according to a conventional method with use of a ferric chloride solution to form a perforated matrix having a perforation of 0.2 mm $\phi$ in the design standard value to produce a shadow mask.

This shadow mask was supported horizontally with two pieces of bearers, and light was irradiated from an upper oblique position of the shadow mask to visually observe a state of the reflection on the surface.

As a result, the surface was found to exhibit substantially a homogeneous state of the reflection, and no local spot pattern or the like was observed. This is a phenomenon that can establish that no surface defect is present on the surface of the shadow mask.

For comparison, the present Example was repeated to produce a shadow mask, except that a conventional Invar alloy in which the non-metallic inclusions are uniformly dispersed under a cleanliness of 0.09% was used, and the presence or absence of surface defects was observed to reveal that there were observed a plurality of patterns in an insular fashion.

As will be clear from Examples 1, 2 and 3, the Invar alloy of this invention contains the non-metallic inclusions dispersed in its inner part in an amount as small as 0.07% or less in terms of cleanliness. Accordingly, less protuberances of the non-metallic inclusions may appear at the perforations to be bored when a perforated matrix is formed by etching, and there can be produced a shadow mask that may not depart from the design standard, bringing about its great industrial value.

Also, as will be clear from Example 4, in the instance in which a shadow mask was produced from the Invar alloy original sheet of Example 2, the occurrence of the surface defects can be extremely decreased as compared with the conventional original sheet. Since the production of the original sheet is carried out by the continuous casting process, the productivity can be made higher to enable the reduction of cost, advantageously.

We claim:

1. A Ni-Fe base alloy having low thermal expansion characteristics in the form of a sheet for use in the production of a shadow mask, wherein said alloy sheet has the cleanliness measured by the method regulated in JIS G 0555, of 0.07% or less.

2. The alloy sheet of claim 1, wherein the amount of non-metallic inclusions present at the surface of the sheet is smaller than the amount of those present at the thicknesswise central part of the sheet.

3. The alloy sheet of claim 2, wherein the non-metallic inclusions present at the surface part of the sheet is in an amount such that the value of the cleanliness measured by the method regulated in JIS G 0555 is 0.01% or less, and the cleanliness at the thicknesswise central part is 0.03% or less.

4. A shadow mask comprising an alloy sheet having the cleanliness measured by the method regulated in JIS G 0555, of 0.07% or less.

5. The shadow mask of claim 4, wherein the amount of non-metallic inclusions present at the surface of the sheet is smaller than the amount of those present at the thicknesswise central part of the sheet.

6. The shadow mask of claim 5, wherein the non-metallic inclusions present at the surface part of the sheet is in an amount such that the value of the cleanliness measured by the method regulated in JIS G 0555 is 0.01% or less, and the cleanliness at the thicknesswise central part is 0.03% or less.

* * * * *